US008686264B2

(12) United States Patent
Morita et al.

(10) Patent No.: US 8,686,264 B2
(45) Date of Patent: Apr. 1, 2014

(54) PERCUSSION INSTRUMENT APPARATUS, SYSTEM AND PROCESS

(75) Inventors: Yutaka Morita, Hamamatsu (JP); Yoshiaki Mori, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 121 days.

(21) Appl. No.: 13/545,913

(22) Filed: Jul. 10, 2012

(65) Prior Publication Data

US 2013/0152765 A1 Jun. 20, 2013

(30) Foreign Application Priority Data

Dec. 14, 2011 (JP) ..... 2011-273165

(51) Int. Cl.
*G10D 13/02* (2006.01)

(52) U.S. Cl.
USPC ..... 84/413

(58) Field of Classification Search
USPC ..... 84/411 R, 421, 413
See application file for complete search history.

(56) References Cited

U.S. PATENT DOCUMENTS

| | | | | |
|---|---|---|---|---|
| 4,475,434 | A | 10/1984 | Willis | |
| 4,947,725 | A | 8/1990 | Nomura | |
| 5,105,710 | A | 4/1992 | Rothmel | |
| 7,074,996 | B2 | 7/2006 | Simons et al. | |
| 7,612,273 | B2 | 11/2009 | Matsuyuki et al. | |
| 8,183,450 | B2 * | 5/2012 | Yoshino et al. | 84/411 R |
| 2004/0016336 | A1 | 1/2004 | Hagiwara | |
| 2005/0223880 | A1 | 10/2005 | Yoshino et al. | |

FOREIGN PATENT DOCUMENTS

| | | |
|---|---|---|
| JP | 2007-249140 | 9/2007 |
| JP | 2007-249141 | 9/2007 |

* cited by examiner

*Primary Examiner* — Kimberly Lockett
(74) *Attorney, Agent, or Firm* — Foley & Lardner LLP

(57) ABSTRACT

A percussion instrument includes a mainframe having a bottom part defining a lower surface. A head is tensioned over an inner part of the mainframe. A hoop structure is arranged over the outer periphery of the head and applies tension to the head. The hoop structure has a lower surface provided with a plurality of recesses. Female threaded connector parts are contained within the recesses. A plurality of bolts extend through the bottom part of the mainframe and engage the female threaded connector parts, to affix the hoop structure to the mainframe. The bolts extend into the bottom part of the mainframe, such that exposure of the bolts on the upper surface side of the hoop structure can be avoided.

20 Claims, 8 Drawing Sheets

PERCUSSION INSTRUMENT APPARATUS, SYSTEM AND PROCESS

CROSS-REFERENCE TO RELATED PATENT APPLICATIONS

Japan Priority Application No. 2011-273165, filed Dec. 14, 2011, including the specification, drawings, claims and abstract, is incorporated herein by reference in its entirety.

FIELD OF THE INVENTION

Embodiments of the present invention relate, generally, to percussion instruments, components of percussion instruments, processes of making and using such percussion instruments and systems employing such percussion instruments. Particular embodiments of the invention relate to percussion instrument systems, apparatuses and processes that employ a structure that can improve the cosmetic appearance of the striking surface side and enhance the mechanical strength of threaded female connectors while allowing effective threaded connecting actions to occur between bolts and the threaded female connectors that secure and tensioning striking heads to percussion instrument bodies.

BACKGROUND

Attempts have been made to configure an electronic percussion instrument or a percussion instrument for practice in a manner to simulate an acoustic percussion instrument. For example, Japanese Laid-open Patent Application 2007-249140 describes an electronic percussion instrument 1 equipped with a shell part 2 (a mainframe), a head 5, a hoop 4, and engaging bolts 7 (bolts). The shell part 2 has a generally hollow cylindrical shape. The head 5 is configured as a striking surface to be struck. The hoop 4 imparts tension to the head 5. The engaging bolts 7 (bolts) connect, in a threading manner, the hoop 4 to the shell part 2.

However, according to such electronic percussion instruments 1 as described above, the engaging bolts 7 are inserted into bolt holes 4*b* of the hoop 4 from the striking surface side of the head 5, and engage in a threading manner with female threaded connectors 2*e* formed in the shell part 2. Therefore, head ends of the engaging bolts 7 are exposed and viewable from the striking surface side of the hoop 4, which can adversely effect the appearance of the striking surface side of the instrument.

SUMMARY OF THE DISCLOSURE

Embodiments of the present invention employ an instrument structure in which the bolts are inserted from the lower surface side of the shell portion and engaged, in a threading manner, with a hoop structure inside the shell portion. As a result, the head of the bolts are not in view from the upper surface side (the striking surface side) of the percussion instrument.

In order to connect, in a threading manner, the bolts to the hoop structure inside the shell part, threaded female screw holes may be formed in the hoop structure. However, when the hoop structure is formed from a resin material or the like having a lower rigidity than that of the bolts, the screw-threads can be damaged and wear out, for example, if the bolts are screwed in the threaded holes diagonally. According to another method of connecting, in a threading manner, the bolts to the hoop structure inside the shell part, nuts may be fixedly bonded to the hoop structure. However, typically, such nuts cannot be viewed from outside of the instrument, making it difficult to axially align and screw the bolts into the nuts.

Embodiments of the present invention relate to a percussion instrument with a configuration that can improve the cosmetic appearance of its striking surface side, and which can secure components with the mechanical strength of threaded connecting bolts and the female threaded connectors.

In a percussion instrument according to an embodiment of the present invention, the male threaded parts of the bolts are inserted through bolt holes formed in the bottom part of a mainframe. The male threaded parts are engaged and threaded with recessed parts formed in the hoop structure, to affix the hoop structure to the mainframe. In this manner, the bolts are inserted in the mainframe from the lower surface side of the mainframe, and are engaged and threaded with parts that are recessed inside the mainframe. Therefore, the configuration avoids exposing the bolts at the upper surface side of the hoop structure, which is placed on the striking surface side. In that regard, the cosmetic appearance of the striking surface side can be improved.

According to further embodiments of a percussion instrument as described above, the upper surface of the hoop structure is downwardly sloped from its outer circumference side toward its inner circumference side. Therefore, when the head is struck, an accidental striking of the hoop structure would more likely be avoided.

By arranging the upper surface of the hoop structure generally flush with the head, the upper surface of the hoop structure can appear more uniform with the head, making the head appear larger. On the other hand, because the dimension of the hoop structure in its radial direction is made sufficiently large to accommodate the recessed parts formed in the hoop structure, the hoop structure might more likely be struck by error during performance of the percussion instrument.

Therefore, according to embodiments of the present invention, the upper surface of the hoop structure is downwardly sloped from the outer circumference toward the inner circumference, making the inner circumferential side of the hoop structure that is closer to the head more difficult to be strike. Accordingly, while the upper surface of the hoop structure can be made to appear more uniform with the head, generation of noise from an accidental striking of the hoop structure would more likely be avoided.

According to a further embodiment of a percussion instrument as described above, sealing members that seal the recessed parts are affixed to the lower surface of the hoop structure, and nuts are loosely fitted in the recessed parts. Therefore, such embodiments can accommodate dimensional errors that can occur at the time of manufacturing of the nuts and the hoop structure.

Also, because the nuts are loosely fitted in the recessed parts, the nuts can move within the recessed part to bring the nut into proper alignment with the male threaded part of a bolt. Therefore, when the male threaded part of the bolt is inserted in the recessed part, even if inserted diagonally with respect to the axial direction of the nut, the male threaded part of the bolt can engage and move the nut to bring the male threaded part in alignment with the axial direction of the nut. Accordingly, the threaded engagement of the bolts with the nuts can be effectively performed.

According to a further embodiment of a percussion instrument as described above, each of the recessed parts not only includes a first accommodating part in which the nut is loosely fitted, but also includes a second accommodating part recessed in a receded bottom surface of the first accommodating part. The second accommodating part, as viewed from the bottom surface side of the hoop structure, has an inner circumferential contour that is smaller than the external contour of the nut as viewed in the axial direction, and greater than the outer diameter of the male threaded part of the bolt. Therefore, the bolt can be inserted into the first accommodating part through the lower surface side of the hoop structure and inserted, in a threading manner, in the nut. In that arrangement, the free end of the male threaded part of the bolt that protrudes into the recessed bottom part of the first accommodating part can be accommodated in the second accommodating part. Therefore, the free end of the male threaded part of the bolt can be threaded in from the bottom part of the mainframe toward the upper part thereof. Accordingly, a sufficient range of tension adjustments can be applied to secure the head at a desired tension.

According to a further embodiment of a percussion instrument as described above, generally channel shaped sealing members are fitted in the hoop structure, to reinforce the mechanical strength of the hoop structure, which can, otherwise, be lowered due to the recessed parts formed therein.

According to further embodiments of a percussion instrument as described above, the hoop structure includes a fixing part formed above the lower end toward the upper surface side thereof for affixing the sealing member therein. In such embodiments, the lower end of the sealing member is located above the lower end of the hoop main body when the sealing member is affixed to the hoop main body. Accordingly, when the hoop structure is affixed to the frame main body, the sealing members do not abut against the bottom part of the frame body and, thus, do not restrict tightening of the bolts. Accordingly, a sufficient range of tension adjustments can be applied to secure the head at a desired tension.

BRIEF DESCRIPTION OF THE DRAWINGS

FIG. 1 (*b*) is a bottom view of the percussion instrument in accordance with the first embodiment of the invention.

FIG. 3 (*b*) is a side view of the hoop main body viewed in a direction IIIb in FIG. 3 (*a*).

FIG. 4 (*b*) is a cross-sectional view of the hoop main body taken along a line IVb-IVb in FIG. 4 (*a*).

FIG. 4 (*c*) is a cross-sectional view of the hoop main body taken along a line IVc-IVc in FIG. 4 (*a*).

FIG. 5 (*b*) is a plan view of the sealing member of FIG. 5(*a*).

FIG. 5 (*c*) is a side view of the sealing member as viewed in a Vc direction in FIG. 5 (*a*).

FIG. 5 (*d*) is a cross-sectional view of the sealing member taken along a line Vd-Vd in FIG. 5 (*b*), and a side view of sealing bolts.

FIG. 8 (*b*) is a perspective view of sealing members in accordance with the second embodiment.

DETAILED DESCRIPTION

Embodiments of the invention are described below with reference to the accompanying drawings.

Figure 1A:
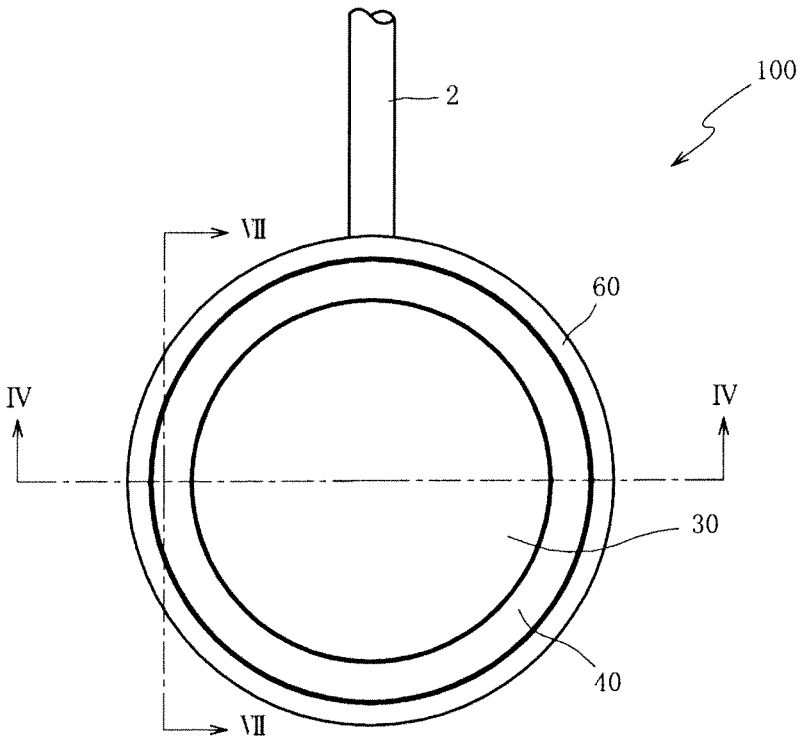
FIG. 1 (*a*) is a plan view of a percussion instrument in accordance with a first embodiment of the invention.
Figure 1B:
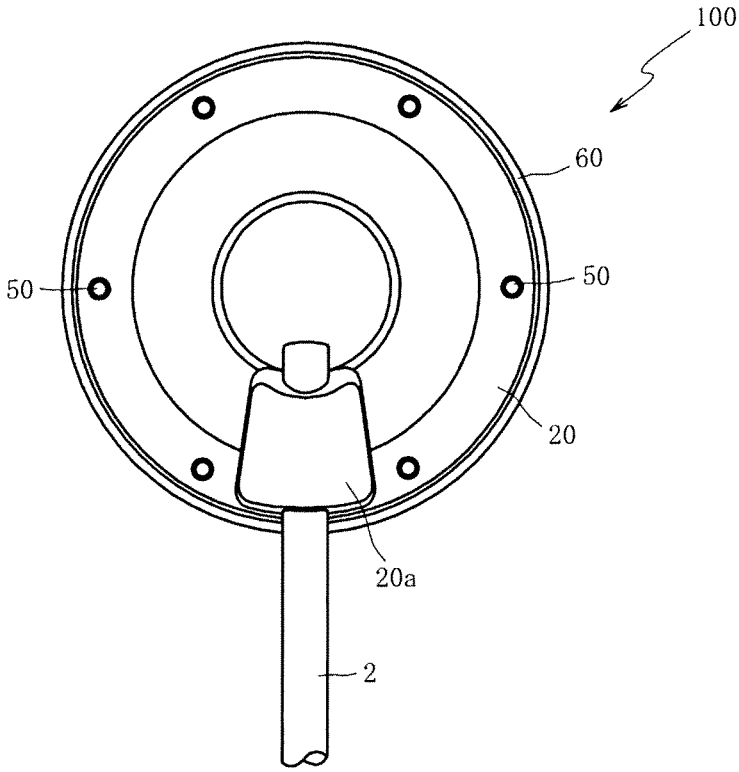

FIGS. 1(*a*) and 1(*b*) show a percussion instrument 100 in accordance with a first embodiment of the invention. FIGS. 1 (*a*) and 1 (*b*) show a state in which the percussion instrument 100 is coupled to a support pipe 2 that may be connected to a drum stand (not shown).

The percussion instrument 100 in FIGS. 1 (*a*) and 1 (*b*) is configured for practice and simulates an acoustic percussion instrument. The percussion instrument 100 includes a mainframe 20, a head 30, a hoop structure 40, a plurality of bolts 50 and a rim cover 60. The mainframe 20 is formed in a bowl shape that is open on its upper side. The head 30 is placed on the upper side of the mainframe 20. The hoop structure 40 is placed on the head 30. The bolts 50 affix the hoop structure 40 to the mainframe 20. The rim cover 60 is fitted onto the outer circumferential side of the hoop structure 40, and mounted on the mainframe 20.

Figure 2:
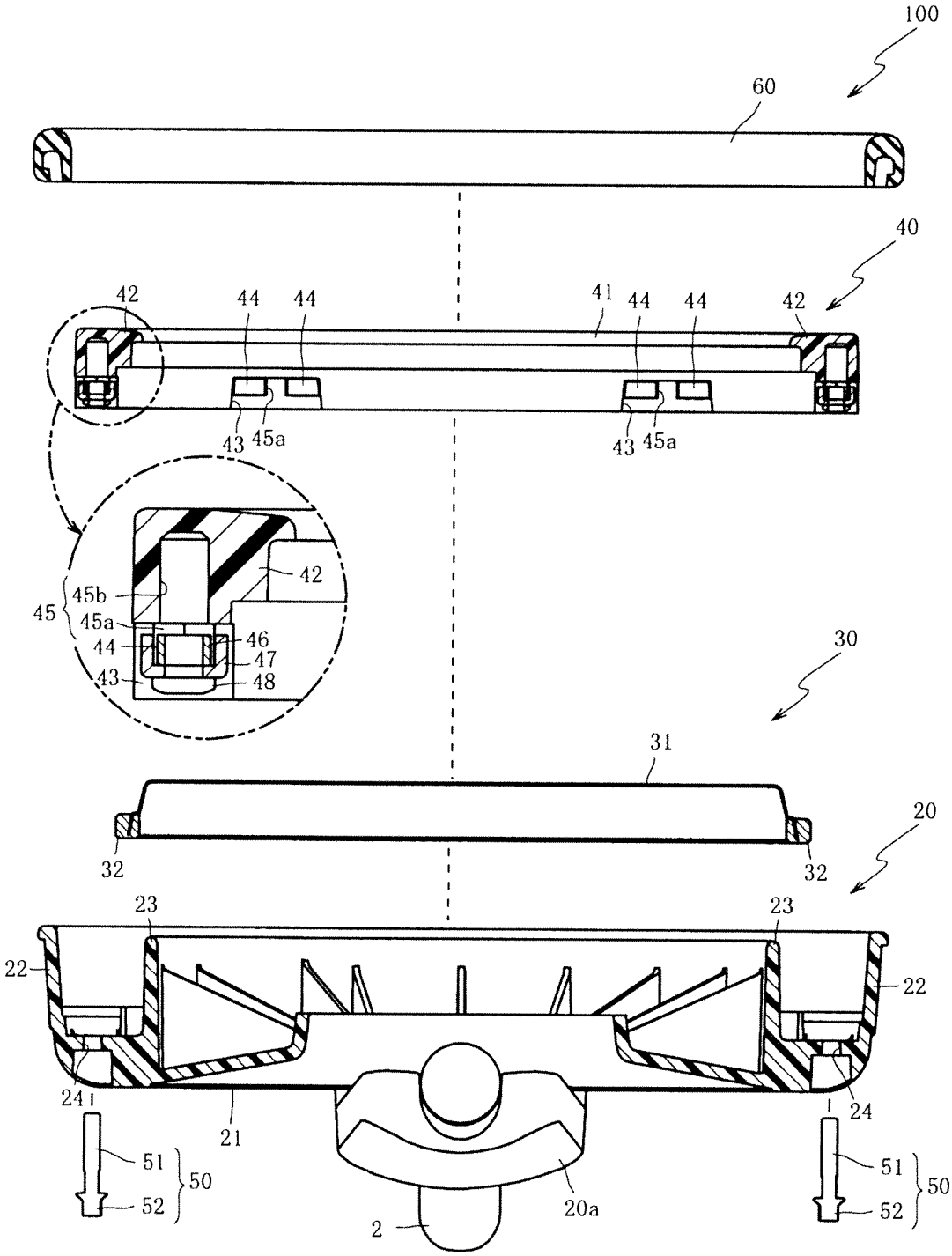
FIG. 2 is an exploded, cross-sectional, side view of the percussion instrument of FIGS. 1(*a*) and 1(*b*).

FIG. 2 is an exploded view of the percussion instrument 100, in a cross-sectional view taken along a line VI-VI in FIG. 1 (*a*).

As shown in FIG. 2, the body of the percussion instrument 100 includes the mainframe 20. The mainframe 20 includes a bottom part 21, a frame outer circumference part 22, a frame inner circumference part 23 and bolt holes 24. The bottom part 21 is a circular part forming a lower surface of the mainframe 20. The frame outer circumference part 22 extends upright at the peripheral portion of the bottom part 21. The frame inner circumference part 23 extends upright at the bottom part 21 on the inner circumferential side of the frame outer circumference part 22. The bolt holes 24 are through-holes defined in the bottom part 21 at positions between the frame inner circumference part 23 and the frame outer circumference part 22.

A pipe coupling part 20*a* that is connected to the support pipe 2 (see FIG. 1) is affixed to the outer circumferential side of the bottom part 21. The frame outer circumference part 22 is a cylindrical part forming the outer circumference surface of the mainframe 20. The frame inner circumference part 23 is a cylindrical part at which the head 30 is provided under tension, and is located concentrically with the frame outer circumference part 22. The bolt holes 24 are holes in which male threaded parts 51 of the bolts 50 (described below) are inserted. The inner circumferential contour of each of the bolt holes 24, as viewed from the lower surface side of the mainframe 20, is circular, and is greater than the outer diameter of the male threaded part 51 of the bolt 50, but smaller than the external contour of a head portion 52 of the bolt 50.

The head 30 includes a film-like striking surface member 31 and a retaining part 32 bonded to the peripheral portion of the striking surface member 31.

The striking surface member 31 is configured to be struck by the performer, and may be composed of a mesh-like material to reduce or minimize acoustic sound produced when struck. Therefore, even when the percussion instrument is used in places such as at home or other location where a striking sound of an acoustic percussion instrument may be an annoyance to other people, the striking sound provided by striking surface member 31 can be relatively faint. Further, by imparting tension to the head 30, the feel of striking the striking surface member 31 is similar to (and simulates) the feel of striking upon striking an acoustic percussion instrument The retaining part 32 is a circular ring shaped part that is retained by the hoop structure 40. The inner diameter of the retaining part 32 is greater than the diameter of the frame inner circumference part 23 of the mainframe 20. Accordingly, the striking surface member 31 can be mounted on the upper end of the frame inner circumference part 23, while the retaining part 32 is placed on the outer circumference side of the frame inner circumference part 23 of the mainframe 20.

The hoop structure 40 is a circular ring shaped part that imparts tension to the head 30. The hoop structure 40 includes a hoop main body 41, a protruded part 42, first recessed parts 43, engagement parts 44, second recessed parts 45, nuts 46, sealing members 47 and sealing bolts 48. The hoop main body 41 is made of any suitably rigid material, such as but not limited to a resin material, and is formed in a circular ring shape. The protruded part 42 extends radially inward from the inner circumference of the hoop main body 41, in a flange shape. Each of the first recessed parts 43 is recessed from the bottom surface of the hoop main body 41 (the lower side surface in FIG. 2) in an upward direction (in an upward direction in FIG. 2). Each of the engagement parts 44 protrudes from the bottom surface of the first recessed part 43 in a downward direction of the hoop main body 41 (in a downward direction in FIG. 2). Each of the second recessed parts 45 is recessed from the lower surface of the engagement part 44 (the lower side in FIG. 2) in an upper direction of the hoop main body 41. The nuts 46 are contained in the second recessed parts 45, and are each formed in a generally hexagonal shape. The sealing members 47 seal the second recessed parts 45 that contain the nuts 46 therein. The sealing bolts 48 affix the sealing members 47 to the lower surface side of the hoop main body 41.

The bolts 50 engage, in a threading manner, the nuts 46 provided in the hoop structure 40, to affix the hoop structure 40 to the mainframe 20. Each of the bolts 50 has a male threaded part 51 and a head part 52. The male threaded part 51 comprises a threaded shaft. The head part 52 is on one end of the male threaded part 51 and has an external contour that is greater than the outer diameter of the male threaded part 51.

The rim cover 60 is a circular ring shaped member that fits onto the upper edge portion of the outer circumference part of the mainframe 20. The rim cover 60 may be made of rubber or other suitable material. A rubber rim cover 60 can reduce striking sound generated upon striking the upper end portion (the rim) of the frame outer circumference part 23.

Figure 3A:
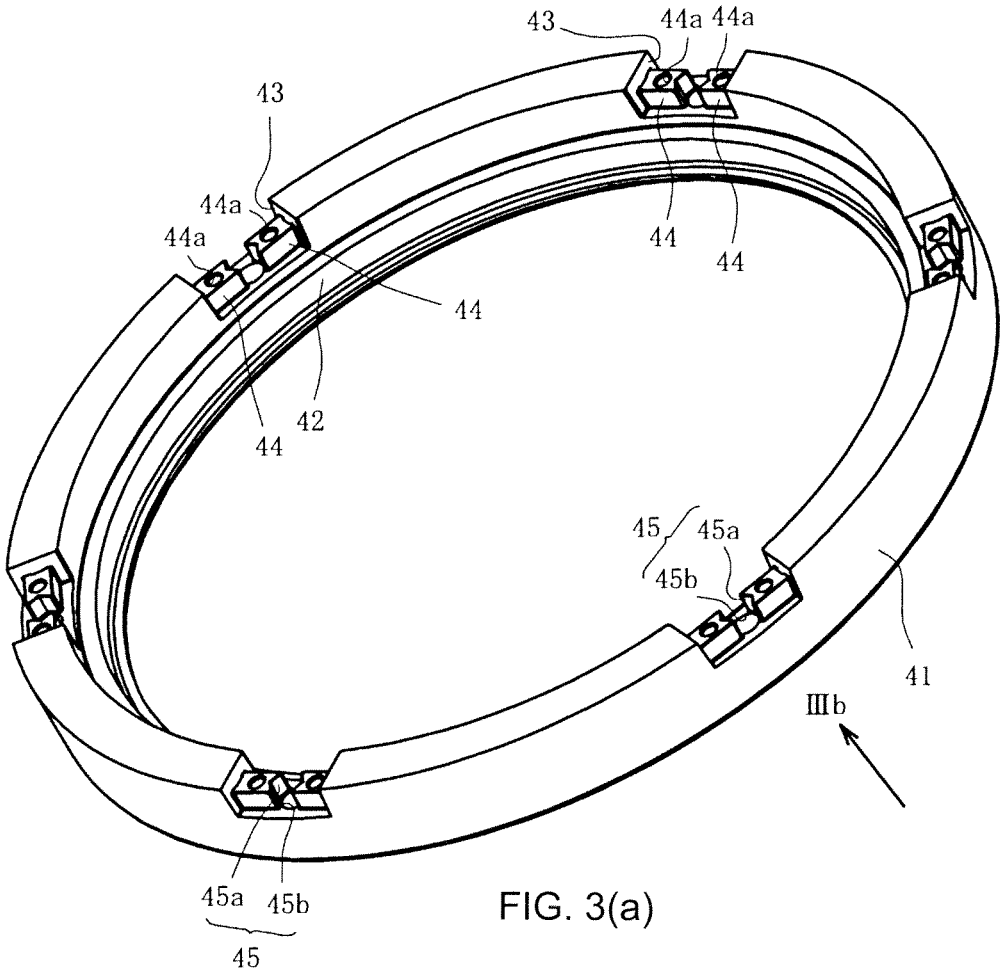
FIG. 3 (*a*) is a perspective view of a hoop main body according to an embodiment, as viewed from its lower surface side.
Figure 3B:
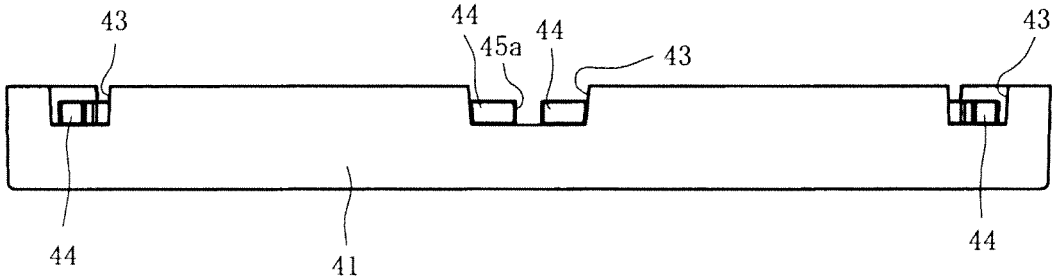

The hoop structure 40 is described in more detail with reference to FIGS. 3(*a*), 3(*b*) 4(*a*) and 4(*b*). The top surface (the lower side surface in FIG. 3 (*b*)) of the hoop main body 41 is downwardly sloped from the outer circumference side toward the inner circumference side. The hoop main body 41 has an outer diameter smaller than the inner diameter of the frame outer circumference part 22 of the mainframe 20 (see FIG. 2). Further, the hoop main body 41 has an inner diameter greater than the outer diameter of the retaining part 32 of the head 30 (see FIG. 2). The hoop main body 41 may be, generally, the same color as the striking surface member 31 (see FIG. 2) of the head 30, and the upper surface of the hoop main body 41 may be made generally flush with the striking surface member 31. Accordingly, the upper surface of the hoop main body 41 and the striking surface member 31 are configured to appear to be uniform, such that the striking surface member 31 appears larger.

The slope angle of the upper surface of the hoop main body 41 may preferably be 15 degrees or less, and more preferably be 5 degrees or less. By minimizing the slope angle of the upper surface of the hoop main body 41, the upper surface of the hoop main body 41 appears more uniform with the striking surface member 31.

The protruded part 42 is a ring shaped part that engages the retaining part 32 of the head 30. The inner diameter of the protruded part 42 is greater than the outer diameter of the frame inner circumference part 23 (see FIG. 2) of the mainframe 20. Further, the inner diameter of the protruded part 42 is smaller than the outer diameter of the retaining part 32 of the head 30. Accordingly, when the striking surface member 31 of the head 30 is placed on the upper edge of the frame inner circumference part 23, the hoop structure 40 is fitted in a gap between the frame outer circumference part 22 and the frame inner circumference part 23 from the upper surface side (on the upper side in FIG. 2) of the mainframe 20. As a result, the engagement part 32 of the head 30 engages the protruded part 42 of the hoop structure 40, and tension is imparted to the striking surface member 31.

The sealing members 47 are provided over an opening of the first recessed parts 43. Each of the first recessed parts 43 is a recess having a generally square channel shape as viewed in the radial direction. The engagement parts 44 are columnar parts that engage the sealing members 47. The engagement parts 44 are provided in a manner to protrude from central portions of the inner, downward-facing surfaces of the first recessed parts 43. Further, the engagement parts 44 extend in a direction perpendicular to the radial direction of the hoop main body 41. Also, the engagement parts 44 are provided in their downward-facing surfaces (the upper sides in FIG. 4 (*c*)) with two female screw holes 44*a* having threaded inner surfaces in which the sealing bolts 48 (see FIG. 5 (*d*)) are screwed. Further, the second recessed part 45 is formed between these two female screw holes 44*a*.

The second recessed parts 45 are parts in which the male threaded parts 51 of the bolts 50 (see FIG. 2) are inserted when the hoop structure 40 is affixed to the mainframe 20. Each of the second recessed parts 45 has a first accommodating part 45*a* and a second accommodating part 45*b*. The first accommodating part 45*a* is recessed in the downward-facing surface of the engagement parts 44. The second accommodating part 45*b* is recessed in the inner, downward-facing surface of the first accommodating part 45*a*.

The first accommodating parts 45*a* have volume portions that accommodate the nuts 46 (see FIG. 2). Each of the first accommodating parts 45*a* has an inner circumferential configuration in a generally hexagonal shape as viewed from the lower surface side of the hoop main body 41 (viewed from the front of the drawing surface of FIG. 4 (*a*)). Also, the receding depth of the first accommodating part 45*a* (the dimension from the lower surface of the engagement parts 44 to the receded bottom surface of the first accommodating part 45*a*) is greater than the dimension of the nut 46 in the thickness direction (in the vertical direction in FIG. 2). Further, the inner circumferential contour of the first accommodating part 45*a* as viewed from the lower surface side of the hoop main body 41 is greater than the external contour of the nut 46 viewed in an axial direction (the vertical direction in FIG. 2). Therefore, the nuts 46 accommodated in the second recessed parts 45 can be loosely fitted inside the first accommodating parts 45*a*.

Each of the second accommodating parts 45*b* has a generally circular inner circumferential shape, as viewed from the lower surface side of the hoop main body 41. Also, the inner circumferential contour of the second accommodating parts 45*b*, as viewed from the lower surface side of the hoop main body 41, is smaller than the external contour of the nut 46, as viewed in an axial direction (in the vertical direction in FIG. 2), and greater than the outer diameter of the male threaded part 51 of the bolt 50. Accordingly, after having engaged, in a threading manner, the nut 46 inside the first accommodating part 45*a*, the male threaded part 51 of the bolt 50 protrudes from the nut 46 into the receded surface side of the first accommodating part 45*a* and is accommodated in the second accommodating part 45*b*.

Figure 4A:
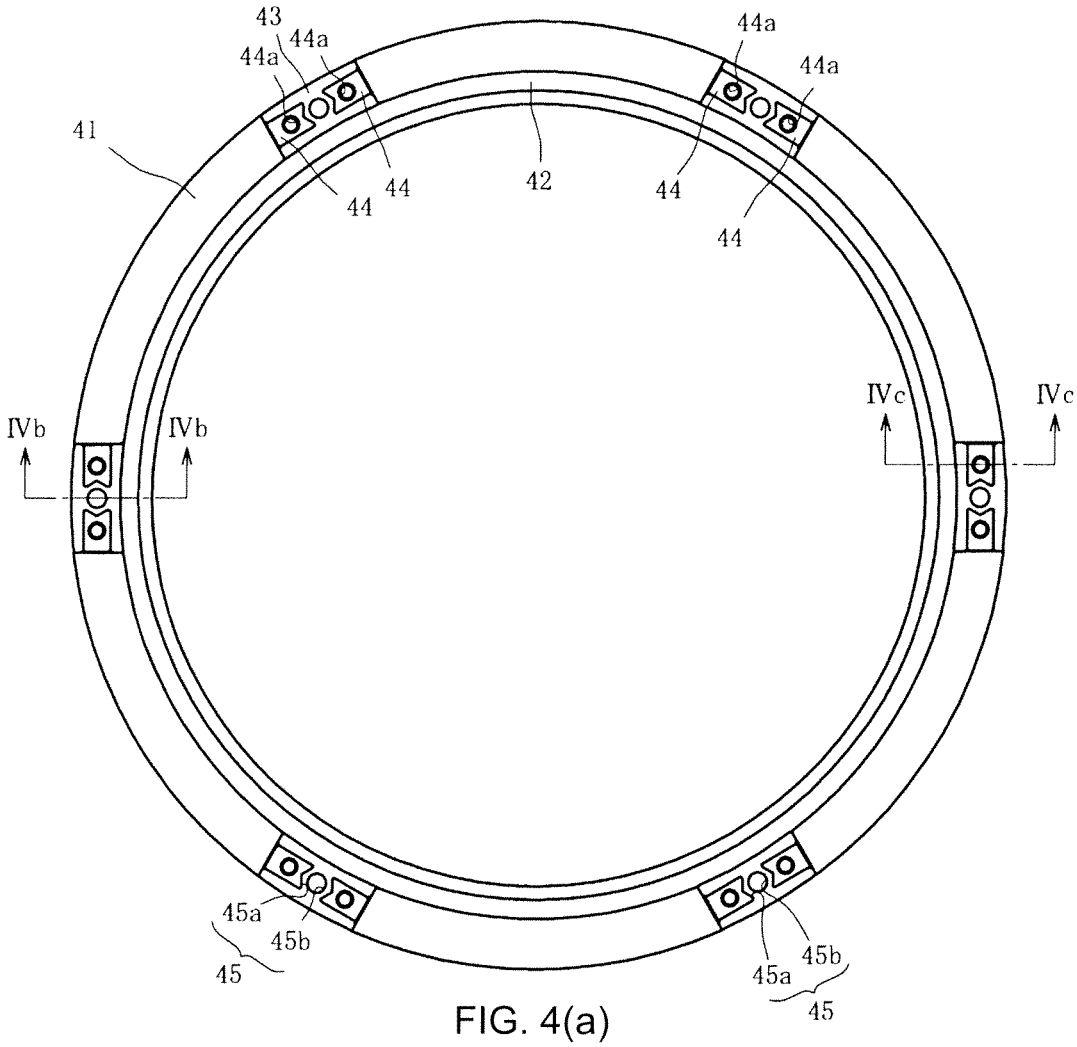
FIG. 4 (*a*) is a bottom view of the hoop main body of the embodiment of FIGS. 3(*a*) and 3(*b*).
Figure 4B:
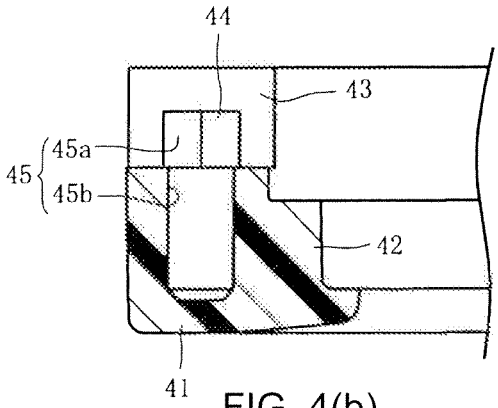
Figure 4C:
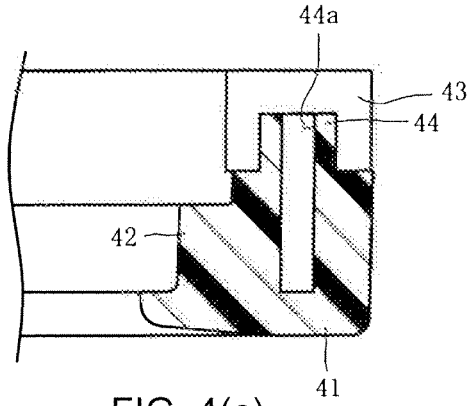
Figure 5A:
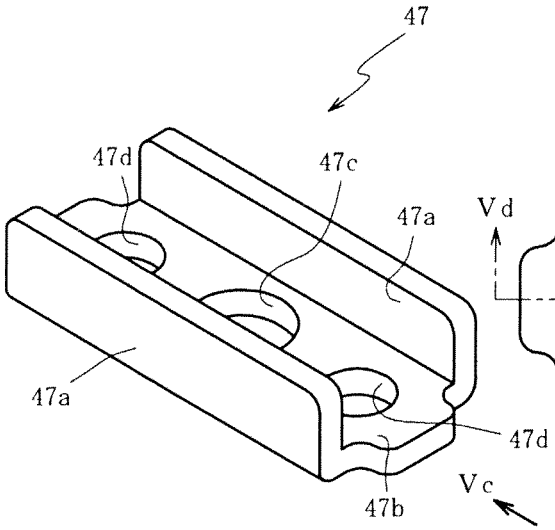
FIG. 5 (*a*) is a perspective view of a sealing member according to an embodiment.
Figure 5B:
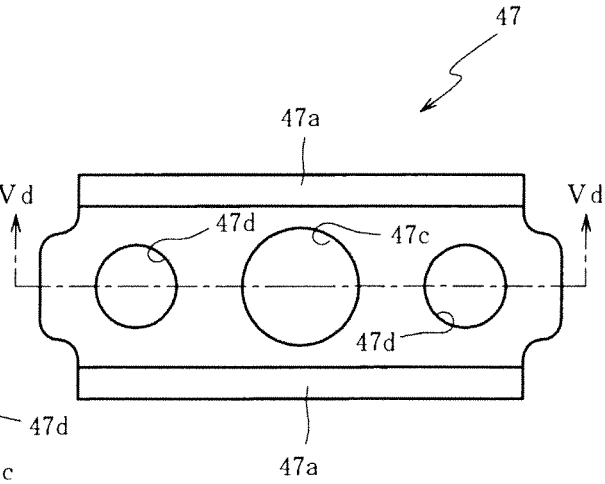
Figure 5C:
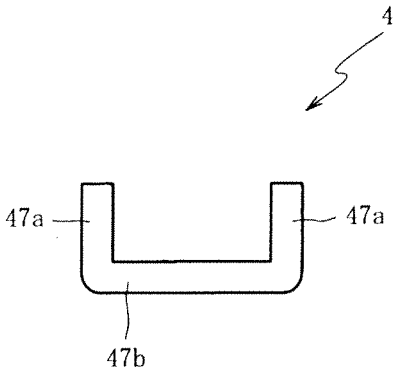
Figure 5D:
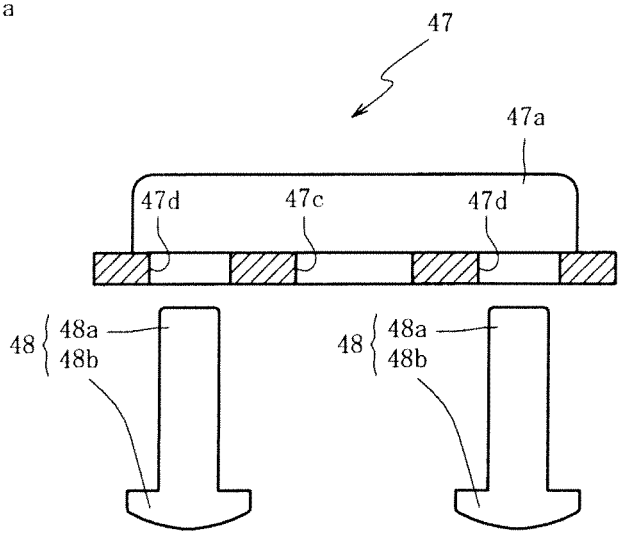

The dimension of the first accommodating part 45*a* in the vertical direction and the dimension of the inner circumference surface of the first accommodating part 45*a*, as viewed from the lower surface side of the hoop main body 41, are selected such that the axial direction of the nut 46 loosely fitted in the first accommodating part 45*a* can be tilted in all directions by about 5 degrees with respect to the receding direction of the first accommodating part 45*a* (in the vertical direction in FIG. 4(*b*)). Therefore, the nut 46 located within the accommodating part 45*a* is prevented from rotating about an axis perpendicular to the axial direction of the nut 46. Also, the first accommodating part 45*a* has the inner circumferential configuration that is in a generally hexagonal shape as viewed from the lower surface side of the hoop main body 41, corresponding to the generally hexagonal shape of the nut 46 loosely fitted in the first accommodating part 45*a*. Therefore, when the male threaded part 51 of the bolt 50 is screwed in the nut 46, the nut 46 can be prevented by the inner wall surface of the first accommodating part 45*a* from rotating with the bolt 50 about the axis of the nut 46.

An example embodiment of the sealing member 47 is shown in FIGS. 5(*a*), 5(*b*), 5(*c*) and 5(*d*).

The sealing bolt 48 has a shaft part 48*a* and a larger diameter head part 48*b*. The shaft part 48*a* is threaded with a male screw thread. The larger diameter head part 48*b* connects to one end side of the shaft part 48*a* and has an outer contour or diameter that is greater than the outer diameter of the shaft part 48*a*.

The sealing member 47 has a generally channel shape and is made of any suitably rigid material, such as but not limited to a metal material. The sealing member 47 has a pair of sidewall parts 47*a* and a connecting part 47*b*. The sidewall parts 47*a* are arranged opposite and facing each other. The connecting part 47*b* extends orthogonal to the pair of sidewall parts 47*a*, and connects the pair of the sidewalls 47*a* together at one ends thereof (at the lower ends in FIG. 5 (*c*)).

The separation distance between the pair of sidewall parts 47*a* is generally the same as or greater than the dimension of the engagement part 44 in the width direction (in the radial direction of the hoop main body 41, or in the horizontal direction in FIG. 4 (*b*)). Accordingly, the sealing member 47 can be fitted over and onto the engagement part 44.

The connecting part 47*b* includes a first through-hole 47*c* and second through-holes 47*d*. The male threaded part 51 of the bolt 50 (see FIG. 2) can be inserted through the first through-hole 47*c*. The shaft parts 48*a* of the sealing bolts 48 can be inserted through the second through-holes 47*d*. The first through-hole 47*c* and the second through-holes 47*d* are formed at positions in corresponding alignment with the positions at which the female screw holes 44*a* and the second recessed part 45 are located. Therefore, when the sealing member 47 is affixed to the lower surface of the hoop main body 41 (see FIG. 2) by the sealing bolts 48, the male threaded part 51 of the bolt 50 can be inserted in the first through-hole 47*c* and guided into the second recessed part 45.

The sum of the thickness of the connecting part 47*b* of the sealing member 47 and the thickness of the greater diameter part 48*b* of the sealing bolt 48 is smaller than the difference in dimension between the lower end surface of the hoop main body 41 and the lower surface of the engagement part 44 in the vertical direction. Accordingly, when the sealing member 47 is affixed to the engagement parts 44 by the sealing bolts 48, the sealing member 47 and the sealing bolts 48 do not protrude lower than the lower end of the hoop main body 41.

Figure 6:
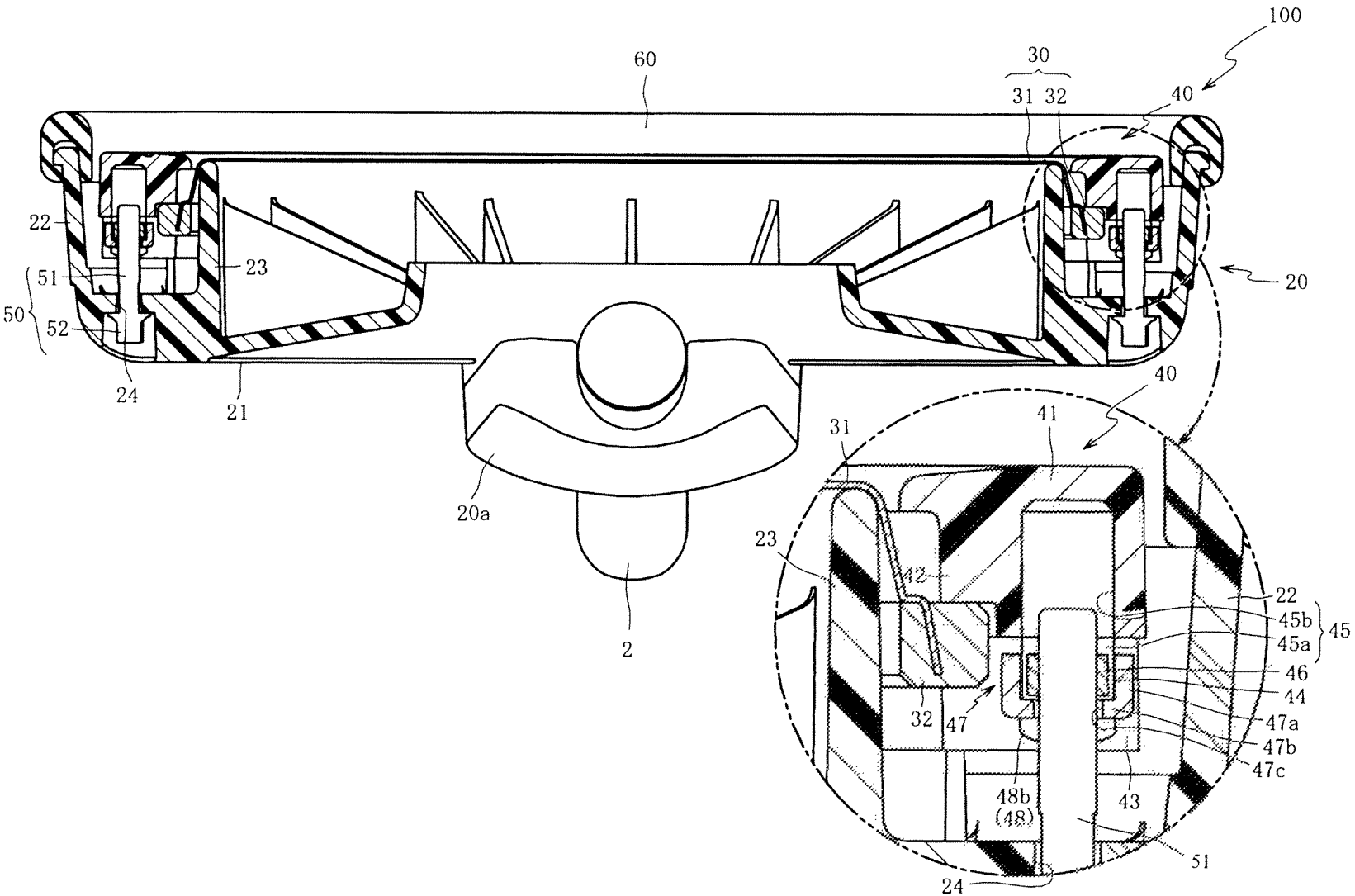
FIG. 6 is a cross-sectional view of the percussion instrument 100 taken along a line VI-VI in FIG. 1 (*a*).
Figure 7:
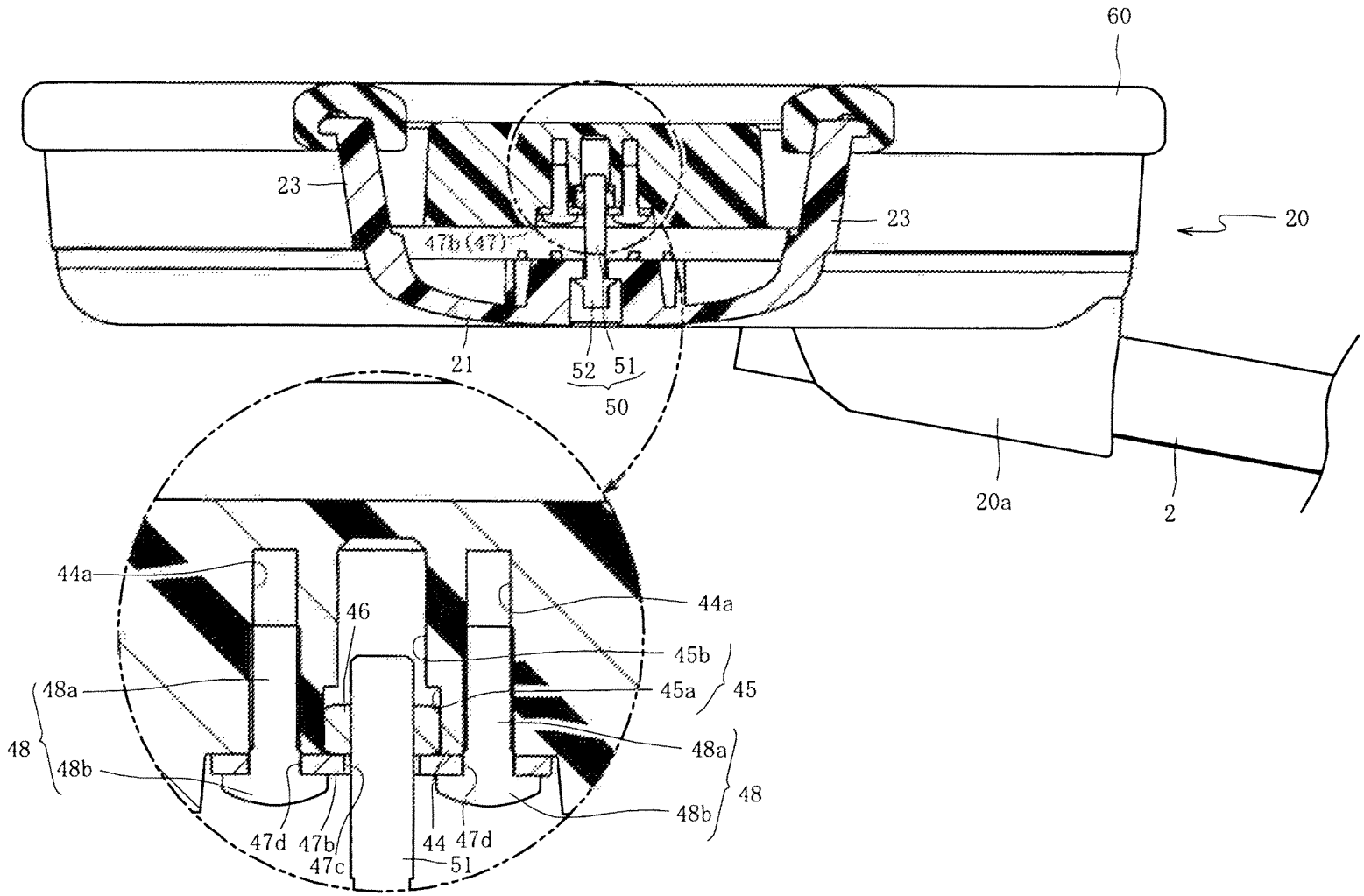
FIG. 7 is a cross-sectional view of the percussion instrument 100 taken along a line VII-VII in FIG. 1 (*a*).

In FIGS. 6 and 7, the percussion instrument 100 is shown with the hoop structure 40 affixed to the mainframe 20 by the bolts 50.

The head 30 is disposed over the mainframe 20 in a manner that the retaining part 32 of the head 30 is placed on the outer circumferential side of the frame inner circumference part 23. The striking surface member 31 of the head 30 is placed on the upper edge part of the frame inner circumference part 23. The hoop structure 40 is fitted, from the upper surface side of the mainframe 20, into a gap between the frame outer circumference part 22 and the frame inner circumference part 23. As a result, the retaining part 32 of the head 30 and the protruded part 42 of the hoop structure 40 engage one another. The male threaded parts 51 of the bolts 50 are inserted through the bolt holes 24 formed in the bottom part 21 of the hoop structure 40 into the interior of the mainframe 20, and the head parts 52 of the bolts 50 are retained at the bottom part 21. The male threaded parts 51 inserted in the mainframe 20 are passed through the first through-holes 47*c* of the sealing members 47 affixed to the lower surface of the hoop main body 41 of the hoop structure 40, and enter the second recessed parts 45. Further, the male threaded parts 51 are engaged, in a threading manner, with the nuts 46 that are loosely fitted in the first accommodating parts 45*a* of the second recessed parts 45. As a result, the bolts 50 engage, in a threading manner, the hoop structure 40. Accordingly, the hoop structure 40 is affixed to the mainframe 20, and can be pulled toward the bottom part 21 of the mainframe 20 as the bolts 50 are tightened. By pulling the hoop structure 40 toward the bottom part 21, tension is applied to the striking surface member 31 of the head 30, and the head 30 is secured on the mainframe 20.

In this manner, the bolts 50 are inserted in the mainframe 20 from the lower surface side of the mainframe 20, the head parts 52 of the bolts 50 are retained by the bottom part 21 of the mainframe 20, and the male threaded parts 51 engage, in a threading manner, the hoop structure 40 inside the mainframe 20. Therefore, exposure of the bolts 50 at the upper surface side of the hoop structure 40 can be avoided. Accordingly, the cosmetic appearance of the striking surface side of the percussion instrument 100 can be improved.

Further, the bolt holes 24 are formed through the bottom part 21 at positions between the frame outer circumference part 22 and the frame inner circumference part 23 of the mainframe 20. Accordingly, the male threaded parts 51 of the bolts 50 can be disposed inside the mainframe 20. As a result, grease or the like may be applied to the male threaded parts 51 of the bolts 50, yet the grease can be prevented from staining a performers hands, clothing or the like.

Furthermore, when the head 30 is stretched over the mainframe 20, the upper surface of the hoop main body 41 is arranged at a position generally flush with the striking surface member 31 of the head 30. Therefore, the upper surface of the hoop main body 41 appears more uniform with the striking surface member 31 along the plane of the striking surface, thereby making the striking surface 31 appear larger.

Because the nuts 46 are accommodated in the hoop main body 41, the hoop main body 41 can have a greater dimension in the radial direction (in the left-to-right direction in FIG. 6) than that of conventional products. Also, because the upper surface of the hoop main body 41 is arranged at a position generally flush with the striking surface member 31 of the head 30, the hoop structure 40 might be struck by mistake during performance.

Accordingly, in particular embodiments, the upper surface of the hoop main body 41 of the hoop structure 40 is sloped downwardly from the outer circumference side toward the inner circumference side, to help reduce the likelihood of erroneous strikes on the inner circumference side of the hoop main body 41, at positions closer to the striking surface member 31. Therefore, unwanted noise that may be generated upon striking the hoop structure 40 would more likely be avoided.

Further, the second recessed parts 45 are formed in the lower surface of the hoop main body 41, the nuts 46 are accommodated in the second recessed parts 45, and the bolts 50 are engaged, in a threading manner, with the nuts 46. Accordingly, the hoop main body 41 is secured to the mainframe with the mechanical strength of the threaded bolts 50 and nuts 46. In addition, the nuts 46 can be made of any suitably rigid and mechanically strong material, including, but not limited to stainless steel, brass or other alloys and metals, such that wear of the female threads in nuts 46 can be better suppressed, compared to a case where female threads are directly formed in a hoop main body 41 composed of a resin material.

Furthermore, the sealing members 47 are affixed to the lower surface of the hoop main body 41 by the sealing bolts 48, and seal the second recessed parts 45 that accommodate the nuts 46. Accordingly, when the bolts 50 are engaged, in a threading manner, with the nuts 46, a force that pulls the nuts 46 toward the head parts 52 of the bolts 50 acts on the sealing members 47. Therefore, when the bolts 50 thread together with the nuts 46, the resulting stress that acts on the hoop main body 41 can be distributed by the sealing members 47. As a result, the nuts 46 can be less likely to break or fall off from the hoop main body 41, as compared to a case where nuts are directly affixed to a hoop main body.

Also, the nuts 46 that are contained in the second recessed parts 45 are loosely fitted in the first accommodating parts 45*a*. Therefore, dimensional errors that occur at the time of manufacturing the nuts 46 and the hoop structure 40 can be accommodated.

Furthermore, when the male threaded part 51 of the bolt 50 is inserted in the first accommodating part 45*a*, diagonally with respect to the axial direction of the nut 46 (in the vertical direction in FIG. 6), the male threaded part 51 can still be easily engaged, in a threading manner, with the nut 46, because the loosely fitted nut 46 can move within the first accommodating part 45*a* to bring the male threaded part 51 in alignment with the axial direction of the nut 46.

Also, the second recessed part 45 includes the second accommodating part 45*b* recessed in the receded bottom of the first accommodating part 45*a*. Moreover, the inner circumferential shape of the second accommodating part 45*b* as viewed in its receding direction is smaller than the external shape of the nut 46 as viewed in its axial direction, and greater than the outer diameter of the male threaded part 51 of the bolt 50. Therefore, the free end of the male threaded part 51 can be accommodated inside the second accommodating part 45*b*, upon having advanced in the second recessed part 45 from the lower surface side of the hoop main body 41, threaded through the nut 46, and protruded from the nut 46 to the receded bottom surface side (the upper side in FIG. 6) of the first accommodating part 45*a*. Accordingly, the free end of the male threaded part 51 of the bolt 50 can be screwed from the bottom part 21 of the mainframe 20, and into an upper part thereof. As a result, a sufficient range of tension adjusting can be provided to the striking surface member 31 of the head 30.

Furthermore, the sealing members 47, each formed in a generally squared channel shape, are fitted on the engagement parts 44. Accordingly, the mechanical strength of the hoop main body 41, which is lowered due to the first recessed parts 43 and the second recessed parts 45 formed in the hoop main body 41, can be reinforced by the sealing members 47.

Further, as shown in FIG. 7, the sealing members 47 and the sealing bolts 48 are recessed in the hoop main body 41 and, thus, are located above the lower end of the hoop main body 41. Therefore, when the hoop structure 40 is pulled toward the bottom part 21 of the mainframe 20 as the bolts 50 are tightened, the sealing members 47 and the sealing bolts 48 avoid abutting against the bottom part 21 of the mainframe 20 before the lower end of the hoop main body 41 abuts the bottom part 21 of the mainframe 20. Accordingly, the bolts 50 can be tightened without any restriction, to provide a broad range of tension adjusting for the striking surface member 31 of the head 30.

Figure 8A:
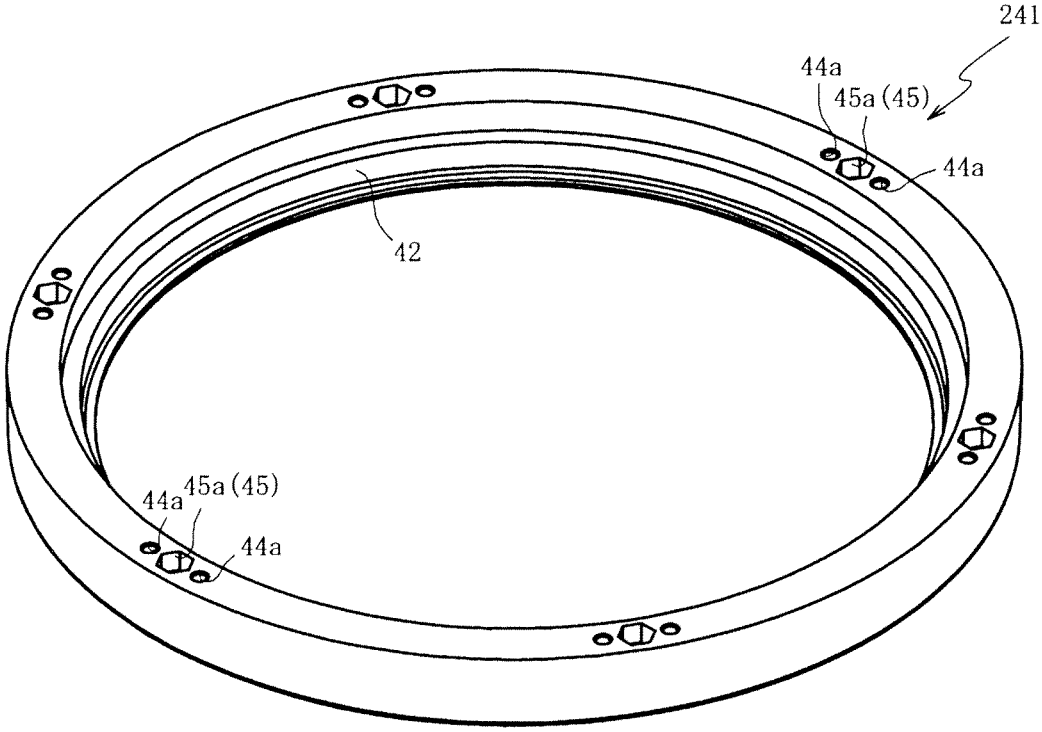
FIG. 8 (*a*) is a perspective view of a hoop main body in accordance with a second embodiment as viewed from below.
Figure 8B:
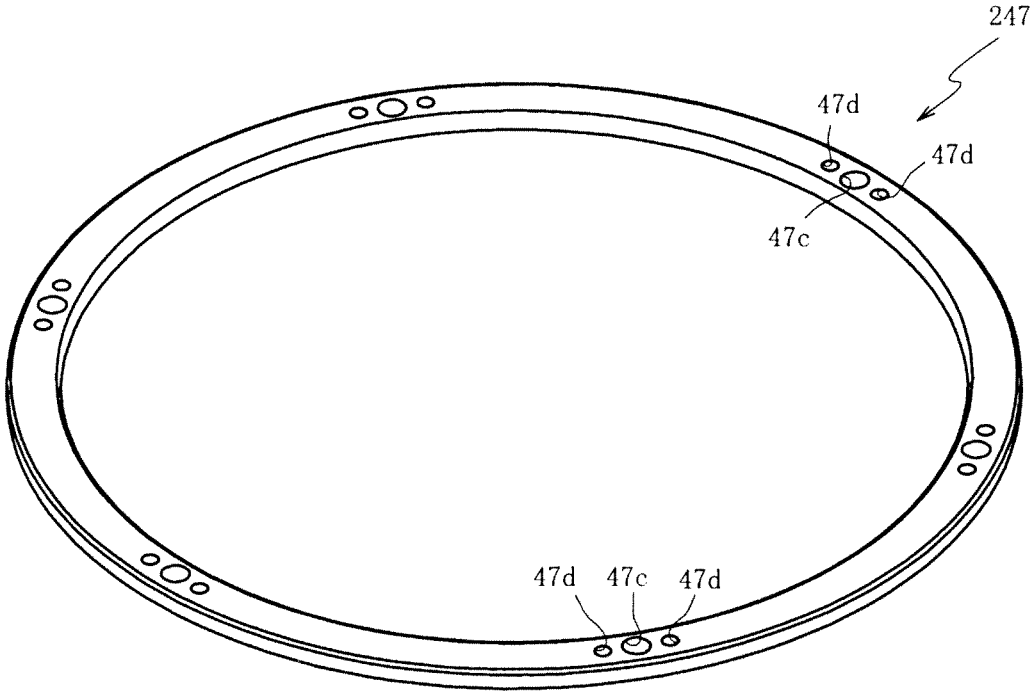

A second embodiment of a hoop main body 241 and a sealing member 247 is shown in FIGS. 8(*a*) and 8(*b*). Embodiments described above include a plurality (for example, but not limited to six) sealing members 47, each formed in a generally squared channel shape, that are affixed to the lower surface of the hoop main body 41. In accordance with the second embodiment in FIGS. 8(*a*) and 8(*b*), the sealing member 247 is formed in a circular ring shape and is affixed to the lower surface of the hoop main body 241. In FIGS. 8(*a*) and 8(*b*), reference numbers that are common to those used in the previously-described embodiments are used to label the same or corresponding parts, and reference is thereby made to the previous descriptions of those parts.

The hoop main body 241 is a circular ring-shaped member made of a resin material. A protruded part 42 protrudes from the inner circumferential surface of the hoop main body 241. Further, second recessed parts 45 and female screw holes 44*a* are formed in the lower surface of the hoop main body 241.

The sealing member 247 is a circular ring-shaped member made of a suitably rigid and strong material, such as, but not limited to a metal material. In other embodiments, the sealing member 247 may be made of a resin material. The sealing member 247 has first through-holes 47*c* and second through-holes 47*d*. The first through-holes 47*c* and the second through-holes 47*d* are formed at positions that correspond to and align with the second recessed parts 45 and the female screw holes 44*a* of the hoop main body 241. Therefore, when the sealing member 247 is affixed to the lower surface of the hoop main body 241 by sealing bolts 48 (see FIG. 5 (*d*)), the first through-holes 47*c* of the sealing member 247 are aligned with the second recessed parts 45 of the hoop main body 241.

Also, because the sealing member 247 is formed in a circular ring-shape, the entire lower surface of the hoop main body 241 can be reinforced by the sealing member 247. Accordingly, deformation of the hoop main body 241 can be suppressed.

The invention has been described above based on example embodiments. However, the invention need not be limited in any particular manner to the embodiments described above, and various improvements and changes can be made without departing from the subject matter of the invention.

For example, in each of the embodiments described above, the invention is applied to a percussion instrument 100 for practice. However, corresponding embodiments of the invention are also applicable to an electronic percussion instrument that is equipped with an electronic sensor for detecting vibration generated when the striking surface member 32 of the head 30 or the rim cover 60 is struck.

Each of the embodiments has been described above with reference to an example in which six of the bolts 50 are used to affix the hoop structure 40 to the mainframe 20. However, in other embodiments, five or less, or seven or more bolts 50 may be used to affix the hoop structure 40 to the mainframe 20. By using five or less bolts 50, the part cost for the bolts 50 and the manufacturing cost for the mainframe 20 and the hoop structure 40 can be reduced. By reducing the number of bolts 50 to be threaded, the work for attaching the bolts 50 to the hoop structure 40 can be simplified. However, more bolts 50 (such as, but not limited to seven or more) can provide a more uniform tension to the striking surface member 32 of the head 30.

In each of the embodiments described above, the sealing member 47 or 247 is affixed to the lower surface of the hoop main body 41 or 241 by the sealing bolts 48. However, in other embodiments, the sealing members 47 or 247 may be affixed to the hoop main body 41 or 241 by other suitable means, including, but not limited to an adhesive or caulking. With this configuration, the sealing bolts 48 may be omitted and, therefore, the part cost can be reduced.

In each of the embodiments described above, the upper surface of the hoop main body 41 or 241 is downwardly sloped from the outer circumference side toward the inner circumference side. However, in other embodiments, the upper surface of the hoop main body 41 or 241 is horizontal. A horizontal upper surface of the hoop main body 41 can be made to appear more uniform with the striking surface member 31 of the head 30, and the striking surface member 31 can be made to appear much larger.

Furthermore, the upper surface of the hoop main body 41 or 241 may be covered by an elastic member made of an elastic material such as rubber. As a result, even when the hoop structure 40 is struck by error during performance, striking sound generated upon striking the hoop structure 40 can be reduced. Also, a sensor may be provided between the upper surface of the hoop main body 41 and the elastic member covering the upper surface of the hoop main body 41, to detect striking of the hoop structure 40.

In each of the embodiments described above, the nuts 46 are accommodated in the second recessed parts 45 formed in the hoop main body 41 or 241, and the bolts 50 are engaged, in a threading manner, with the nuts 46. However, in other embodiments, the hoop main body 41 or 412 is provided with female screw holes directly threaded therein, to engage, in a threading manner with the bolts 50. With this configuration, the sealing members 47 or 247 and the sealing bolts 48 may be omitted, such that the part costs can be reduced.

In each of the embodiments described above, the nuts 46 are loosely fitted in the hoop main body 41 or 241. However, in other embodiments, the nuts 46 are affixed to the hoop main body 41 or 241. With this configuration, the axial direction of the nuts 46 can be fixed as the hoop main body 41 or 241 is retained.

In an embodiment described above, the hoop structure 40 includes the first recessed parts 43 and the engagement parts 44, and the sealing members 47 are affixed to the engagement parts 44. However, in other embodiments, the first recessed parts 43 and the engagement parts 44 may be omitted, and the sealing members may be fitted to the lower surface of the hoop main body 41. In this case, the separation distance between the sidewall parts of the sealing member may be generally the same as the dimension of the hoop main body 41 in the radial direction, or may be greater than the dimension of the hoop main body 41 in the radial direction. With this configuration, the first recessed parts 43 and the engagement parts 44 may be omitted from the hoop main body 41 and, therefore, the manufacturing cost of the hoop main body 41 can be reduced.

The invention claimed is:

1. A percussion instrument comprising:

a mainframe having an opening on an upper side thereof, the mainframe having a bottom part that forms a lower surface thereof, a cylindrical frame outer circumference part that extends upright at a peripheral portion of the bottom part, a frame inner circumference part that has a cylindrical shape smaller in diameter than the frame outer circumference part and extends upright on the bottom part on an inner circumferential side of the frame outer circumference part, and bolt holes through the bottom part at positions between the frame inner circumference part and the frame outer circumference part through which the bolts can be inserted;

a head arranged on the upper side of the mainframe, the head being tensioned over an upper end portion of the frame inner circumference part of the mainframe;

a ring-shaped hoop structure for applying tension to the head, the hoop structure being disposed between the frame outer circumference part and the frame inner circumference part of the mainframe; and a plurality of bolts extending through the bolt holes of the mainframe, each of the bolts has a male threaded part and a head part connected to one end of the male threaded part, the head part having an external contour greater than an outer diameter of the male threaded part;

wherein the hoop structure has recessed parts that are recessed in a lower surface thereof and include female threads that engage, in a threading manner, the male threaded parts of the bolts extending through the bolt holes in the bottom part of the mainframe, to affix the hoop structure to the mainframe.

2. A percussion instrument according to claim 1, wherein the hoop structure has an upper surface that is downwardly sloped from its outer circumferential side toward its inner circumferential side.

3. A percussion instrument according to claim 2, wherein:

the hoop structure includes nuts loosely fitted in the recessed parts, the nuts having the female threads that engage the bolts;

the hoop structure further includes sealing members that close the recessed parts to hold the nuts loosely fitted therein, the sealing members being affixed to the lower surface of the hoop structure;

the sealing members have through-holes through which the male threaded parts of the bolts are inserted to engage, in a threading manner, the nuts in the hoop structure.

4. A percussion instrument according to claim 3, wherein each of the recessed parts has a first accommodating part and a second accommodating part, the second accommodating part being recessed in a receded surface of the first accommodating part and having an inner circumferential shape, as viewed from the lower surface side of the hoop structure, smaller than an external contour of the nut viewed in an axial direction thereof, but greater than an outer diameter of the male threaded part of the bolt.

5. A percussion instrument according to claim 4, wherein each of the sealing members is formed in a generally squared channel shape that is fitted to the hoop structure.

6. A percussion instrument according to claim 5, wherein the hoop structure has a fixing part arranged above the lower surface of the hoop structure to affix the sealing member to the hoop structure, wherein the entire sealing member is located above the lower surface of the hoop structure when the sealing member is affixed to the hoop structure.

7. A percussion instrument according to claim 1, wherein:

the hoop structure includes nuts loosely fitted in the recessed parts, the nuts having the female threads that engage the bolts;

the hoop structure further includes sealing members that close the recessed parts to hold the nuts loosely fitted therein, the sealing members being affixed to the lower surface of the hoop structure;

the sealing members have through-holes through which the male threaded parts of the bolts are inserted to engage, in a threading manner, the nuts in the hoop structure.

8. A percussion instrument according to claim 7, wherein each of the recessed parts has a first accommodating part and a second accommodating part, the second accommodating part being recessed in a receded surface of the first accommodating part and having an inner circumferential shape, as viewed from the lower surface side of the hoop structure, smaller than an external contour of the nut viewed in an axial direction thereof, but greater than an outer diameter of the male threaded part of the bolt.

9. A percussion instrument according to claim 8, wherein each of the sealing members is formed in a generally squared channel shape that is fitted to the hoop structure.

10. A percussion instrument according to claim 3, wherein each of the sealing members is formed in a generally squared channel shape that is fitted to the hoop structure.

11. A percussion instrument according to claim 3, wherein the hoop structure has a fixing part arranged above the lower surface of the hoop structure to affix the sealing member to the hoop structure, wherein the entire sealing member is located above the lower surface of the hoop structure when the sealing member is affixed to the hoop structure.

12. A percussion instrument according to claim 4, wherein the hoop structure has a fixing part arranged above the lower surface of the hoop structure to affix the sealing member to the hoop structure, wherein the entire sealing member is located above the lower surface of the hoop structure when the sealing member is affixed to the hoop structure.

13. A percussion instrument comprising:

a mainframe having a bottom part defining a lower surface of the mainframe, a frame inner part extending upward relative to the lower surface and a frame outer part;

a head tensioned over the frame inner part;

a hoop structure arranged over an outer peripheral portion of the head, to apply tension to the head, the hoop structure being disposed between the frame outer part and the frame inner part, the hoop structure having a lower surface provided with a plurality of recesses, the hoop structure containing female threaded parts within the recesses; and a plurality of bolts extending through the bottom part of the mainframe and engaged, in a threading manner, with the female threaded parts within the recesses of the hoop structure, to affix the hoop structure to the mainframe.

14. A percussion instrument according to claim 13, wherein the hoop structure has an upper surface that is downwardly sloped from its outer circumferential side toward its inner circumferential side.

15. A percussion instrument according to claim 13, wherein:

the female threaded parts in the hoop structure include a plurality of nuts loosely fitted in the recessed parts, the nuts having the female threads that engage the bolts.

16. A percussion instrument according to claim 15, wherein the hoop structure further includes at least one sealing member affixed to the lower surface of the hoop structure to cover at least a portion of the recessed parts to hold the nuts loosely fitted therein.

17. A percussion instrument according to claim 16, wherein the sealing members have through-holes through which the bolts are inserted to engage, in a threading manner, the nuts in the hoop structure.

18. A percussion instrument according to claim 17, wherein the hoop structure has at least one fixing part arranged above the lower surface of the hoop structure to affix the sealing member to the hoop structure, wherein the entire sealing member is located above the lower surface of the hoop structure when the sealing member is affixed to the hoop structure.

19. A percussion instrument according to claim 16, wherein the hoop structure has at least one fixing part arranged above the lower surface of the hoop structure to affix the sealing member to the hoop structure, wherein the entire sealing member is located above the lower surface of the hoop structure when the sealing member is affixed to the hoop structure.

20. A method of making a percussion instrument comprising:

providing a mainframe having an opening on an upper side thereof, the mainframe having a bottom part that forms a lower surface thereof, a cylindrical frame outer circumference part that extends upright at a peripheral portion of the bottom part, a frame inner circumference part that has a cylindrical shape smaller in diameter than the frame outer circumference part and extends upright on the bottom part on an inner circumferential side of the frame outer circumference part, and bolt holes through the bottom part at positions between the frame inner circumference part and the frame outer circumference part through which the bolts can be inserted;

arranging a head on the upper side of the mainframe, over an upper end portion of the frame inner circumference part of the mainframe;

disposing a ring-shaped hoop structure between the frame outer circumference part and the frame inner circumference part of the mainframe and in engagement with the head to applying tension to the head;

extending a plurality of bolts through the bottom part of the mainframe; and providing the hoop structure with recesses in a lower surface thereof and female thread parts within the recesses that engage, in a threading manner, the bolts extending through the bottom part of the mainframe, to affix the hoop structure to the mainframe.

* * * * *